US007967568B2

(12) United States Patent
Dalton et al.

(10) Patent No.: US 7,967,568 B2
(45) Date of Patent: Jun. 28, 2011

(54) GAS TURBINE COMPONENT WITH REDUCED COOLING AIR REQUIREMENT

(75) Inventors: John P. Dalton, Wellington, FL (US); Tilmann Auf Dem Kampe, Greven, DE (US); Frank A. Maichle, Jupiter, FL (US); Rex A. Smith, Port Saint Lucie, FL (US); Stuart P. Bishop, Palm City, FL (US); Stefan Irmisch, Niederrohrdorf (CH)

(73) Assignee: Siemens Energy, Inc., Orlando, FL (US)

( * ) Notice: Subject to any disclaimer, the term of this patent is extended or adjusted under 35 U.S.C. 154(b) by 1185 days.

(21) Appl. No.: 11/858,998

(22) Filed: Sep. 21, 2007

(65) Prior Publication Data

US 2009/0081029 A1 Mar. 26, 2009

(51) Int. Cl.
*F01D 5/18* (2006.01)

(52) U.S. Cl. ..... 416/97 R; 415/115

(58) Field of Classification Search ..... 416/232
See application file for complete search history.

(56) References Cited

U.S. PATENT DOCUMENTS 2,648,520 A * 8/1953 Schmitt ..... 415/115
4,422,229 A * 12/1983 Sadler et al. ..... 29/889.721
4,693,667 A * 9/1987 Lenz et al. ..... 415/115
4,835,958 A 6/1989 Rice
5,630,700 A 5/1997 Olsen et al.
5,772,398 A 6/1998 Noiret et al.
5,813,827 A 9/1998 Nordlund et al.
6,695,582 B2 2/2004 Bunker et al.
6,769,865 B2 8/2004 Kress et al.
7,040,097 B2 5/2006 Mukherjee
7,300,251 B2 * 11/2007 Kitamura et al. ..... 416/97 R

FOREIGN PATENT DOCUMENTS

JP 55109704 A * 8/1980

* cited by examiner

*Primary Examiner* — Richard Edgar

(57) ABSTRACT

Introducing a plurality of geometrically shaped members (27) into a cooling passage (16) of a gas turbine airfoil (10) will effectively reduce the cross-sectional flow area while simultaneously retaining a sufficiently thick external contour desired for proper gas path aerodynamic behavior. Small cooling sub-passages (18*a*, 18*b*) formed around the geometric members will create a preferentially higher coolant flow rate and heat transfer coefficient at the cooled surface (14) when compared to the interior of the cavity. The geometric shapes may be metal or ceramic spheres retained in the cooling cavity by a retaining structure such as a screen grid (30) or perforated plate (32). The openings (34) in the retaining structure may be unevenly distributed to preferentially allow more coolant to enter the cavity proximate the cooled walls. The size/shape of the geometrically shaped members may be varied to achieve a desired heat transfer coefficient along the cooled wall surface (17).

16 Claims, 3 Drawing Sheets

GAS TURBINE COMPONENT WITH REDUCED COOLING AIR REQUIREMENT

FIELD OF THE INVENTION

The present invention relates in general to actively cooled devices used in high-temperature applications, and in particular to an improved cooling scheme for a gas turbine engine airfoil.

BACKGROUND OF THE INVENTION

In a gas turbine engine, air is pressurized in a compressor and is mixed with fuel in a combustor for generating hot combustion gases which flow downstream through turbine stages that extract energy therefrom. The turbine includes stationary airfoils (vanes) that direct the combustion gases through respective downstream rows of rotating airfoils (blades) extending radially outwardly from a rotating shaft.

Present-day high performance turbines include vanes that are capable of withstanding temperatures approaching 1600° C. or higher. While high temperature metal alloys and ceramic materials may be used for constructing the vanes and blades, active cooling of the structures with a cooling fluid is required in many applications. Cooling is typically accomplished by directing cooling air through the hollow cavity of the airfoil.

Various schemes have been used in the past to actively cool gas turbine components such as the stationary vanes. For example, in U.S. Pat. No. 5,772,398, entitled COOLED TURBINE GUIDE VANE, a cooled turbine vane is disclosed as including a hollow aerodynamic portion between inner and outer platforms. The interior of the aerodynamic portion is partitioned into a leading edge duct and a main cavity in which a perforated tubular member is disposed, being spaced from the interior and exterior side walls of the vane by longitudinal ribs. The tubular member is divided by a partition into two cavities on the interior and exterior sides of the partition. A first cooling circuit includes the leading edge duct and the interior cavity of the tubular member, and a second cooling circuit includes the exterior cavity and a cooling system for the inner platform, both circuits being supplied with cooling air by the same source from the outer platform. Cooling air from each circuit passes through the perforations of the tubular member to impinge on the inside face of the respective side wall of the vane and is then guided toward the trailing edge, where it escapes through slits in the trailing edge wall.

Another example of a prior art device is disclosed in U.S. Pat. No. 5,813,827, entitled APPARATUS FOR COOLING A GAS TURBINE AIRFOIL. This apparatus includes two radially extending passages connected to the outer shroud to direct a cooling fluid to a plenum formed about mid-span adjacent to the trailing edge. Two arrays of cooling fluid passages extend from the plenum. One array extends radially inward toward the inner shroud. The plenum distributes the cooling fluid to the two arrays of passages so that it flows radially inward and outward to manifolds formed in the inner and outer shrouds. The manifolds direct the spent cooling fluid to a discharge passage.

To utilize the cooling air passing through a gas turbine vane effectively, it is useful to reduce the size of the cooling passage, since cooling air traveling along the center of the passage is not in contact with the surface being cooled. However, the reduction of the internal cooling passage cross-sectional area to a desired degree for cooling purposes would result in an undesirably thin aerodynamic shape or the necessity for installing complicated and costly structures within the vane for directing the fluid flow. A thinner aerodynamic shape requires a larger number of airfoils to produce the desired aero performance, thereby increasing cost and reducing efficiency. A means of improving cooling efficiency without affecting the external airfoil contour is desired.

BRIEF DESCRIPTION OF THE DRAWINGS

The invention is explained in the following description in view of the drawings that show.

DETAILED DESCRIPTION OF THE INVENTION

The present inventors have discovered that a cooling flow passing through a gas turbine airfoil cooling passage can be partially blocked and caused to flow preferentially at a higher rate along the walls of the airfoil passage by filling the passage with a stacked plurality of geometric shapes. The advantageous preferential flow pattern along the walls of the passage is caused by the inability of the geometric shapes to stack as closely against the flat walls as they do stack against each other in the central portions of the passage. The stacked plurality of geometric shapes also provides a tortuous flow path for the cooling fluid, resulting in improved mixing of the fluid without the need for forming ribs or other flow disruption structures on the cooled surface. The partial blockage and preferential flow proximate the walls of the passage created by the stacked geometric shapes provide for a reduced coolant flow rate and a simultaneously improved wall cooling effect. Introducing such stacked geometric shapes into the cooling passage of a gas turbine airfoil allows the use of a sufficiently thick external contour designed for proper combustion gas path aerodynamic behavior without the usual attendant need for a very large cooling air flow or the need for expensive flow directing structures within the airfoil. The flow blockage may be formed using ceramic or metallic shapes, for example spheres, packed into the cooling cavity. The shapes may be retained in the cavity by using a perforated retaining structure such as a grate at both the inlet and outlet ends of the cavity. The retaining structure may be formed to preferentially allow more coolant to enter the cavity proximate the cooled walls, thereby further augmenting the benefits of the present invention.

Figure 1:
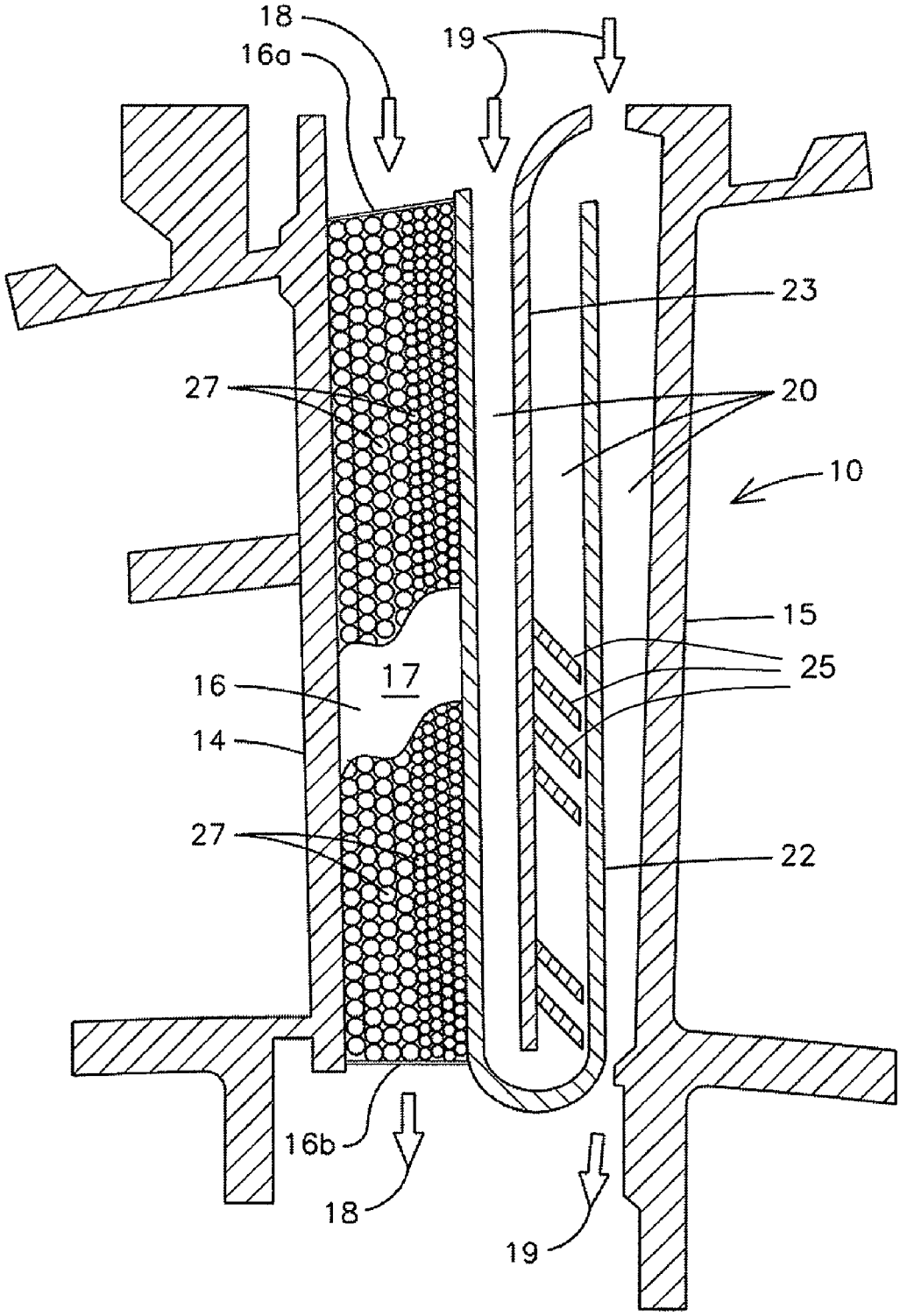
FIG. 1 is a longitudinal cross-sectional view of a gas turbine vane according to one embodiment of the invention.

Referring now to the drawings and in particular to FIG. 1, a cross-sectional view through a gas turbine vane 10 in accordance with one embodiment of the invention is shown. The vane 10 includes pressure and suction side walls 17 joined at respective leading and trailing edges 14, 15, such that a major portion of the vane is hollow. Interior cavity 16 is at least partially defined by the leading edge 14 and airfoil walls 17 which present the surfaces that are to be cooled by a cooling fluid 18. The cavity is open at opposing ends 16*a* and 16*b* thereof for the passage of the coolant 18 there through as defined by the direction of arrows 18. The coolant, which may be air or steam for example, may be divided into another stream defined by arrows 19 that is passed through a serpentine-shaped cavity 20 that is adjacent to the trailing edge 15. The serpentine-shaped cavity 20 may be defined by curved wall-forming members 22 and 23 as are known in the art. On the inner surface of the cavity 20 there may be formed ribs 25, which aid in cooling the walls as the coolant is passed there through.

In accordance with the present invention, a plurality of geometrically-shaped members 27 are placed in the cavity 16, which act to direct the coolant flow 18 preferentially toward the outer walls for cooling thereof. That is, the members 27 form a partial blockage of the flow in the center of the cavity 16, which preferentially forces the coolant toward the outer walls where it is needed for cooling the hot airfoil walls. The members 27 may be any geometric shape that provides for relatively close packing against adjacent members 27 while providing relatively more open packing against an adjacent wall 144. The members may be metallic or ceramic spheres, for example. Typical metallic materials that may be used include commercially available alloys designated in the trade as IN625, IN718, Rene80, or Hastx.

Figure 2:
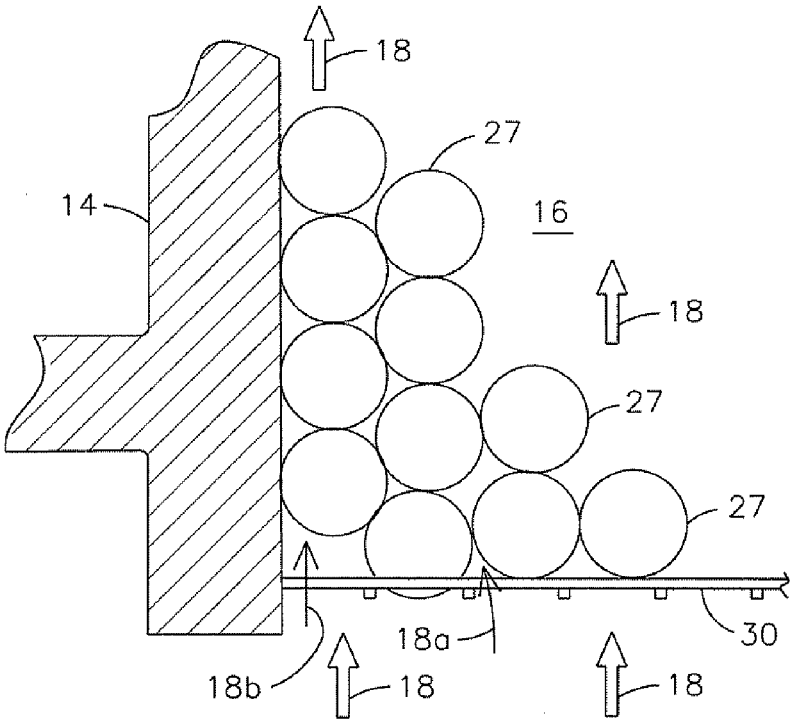
FIG. 2 is an enlarged cross-sectional view of a portion of the vane of FIG. 1.

With reference to FIG. 2, a detailed cross-section of a portion of the structure of FIG. 1 is shown. Note that the geometrically-shaped members 27 are stacked against the relatively flat leading edge 14 and against adjacent members 27. The members 27 define a plurality of small sub-passages 18*a*, 18*b* around the geometric shapes and along the wall 14. The geometric shape of the members 27 allows them to overlap and to interlock to a degree on a three-dimensional basis, whereas the members 27 sit flush against the flat surface 14. As a result, the sub-passages 18*b* along the cooled wall 14 are generally larger and more open than the sub-passages 18*a* toward the center of the passage 16, resulting in a flow through the passage 16 that is biased toward and along the passage wall 14. In one embodiment, the flow rate proximate the wall 14 may be approximately 16% higher than the flow rate remote from the wall, thereby providing a more effective use of the cooling fluid. Furthermore, the coolant is mixed as a result of passing over the members 27, further improving the cooling effectiveness.

Figure 2B:
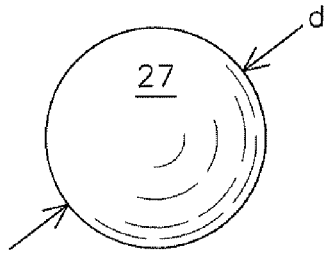
FIG. 2*b* is a diagram of an exemplary sphere that may be used as a geometrically-shaped member in the structure shown in FIG. 2.
Figure 2A:
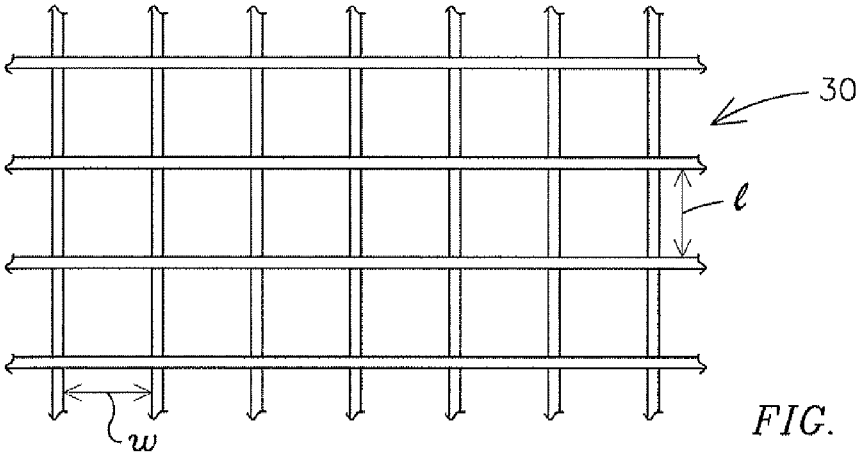
FIG. 2*a* is a diagram of a restraining screen for use with the structure shown in FIG. 2.

In accordance with one embodiment, the members 27 are retained within the cavity 16 by means of a screen grid 30 or other retaining structure, which may be welded to the wall 14 or otherwise supported. Details of the screen grid 30 are shown in the plan view of FIG. 2*a*, wherein at least one dimension of the grid 30 is smaller than the diameter of a spherical member 27 or a minimum dimension of any other shape so that the members 27 are retained by the grid 30 while the coolant is free to flow there through. For example, if the members 27 are spherical and have a diameter d (FIG. 2*b*) and the grid segments are l long and w wide, then d should be greater than l or w. The screen grid 30 may be constructed of any appropriate material, for example In625. Screen openings having other shapes may be used or parallel bars may be used in other embodiments.

The geometrically-shaped members 27 may have a constant size and shape or the size and/or shape may vary within any one cavity 16, as illustrated in FIG. 1 by the somewhat larger sized spheres located proximate the wall 14 that is being cooled and the somewhat smaller sized spheres being located away from the cooled wall and proximate a center of the cavity 16. The size and/or shape of the members 27 also may be varied in response to variations in the size/shape of the cavity 16 or in response to variations in the heat loadings and/or pressure conditions imposed on the component to achieve a desired heat transfer coefficient at all locations along the cavity wall.

Figure 3:
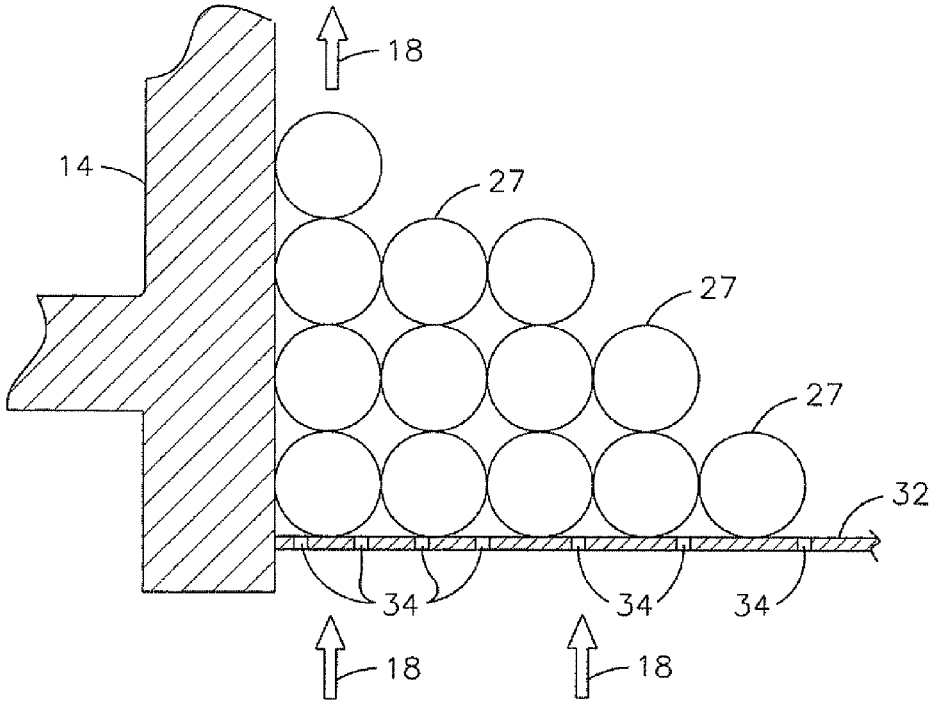
FIG. 3 is an enlarged view of an alternate embodiment of the cross-section of FIG. 1.
Figure 3A:
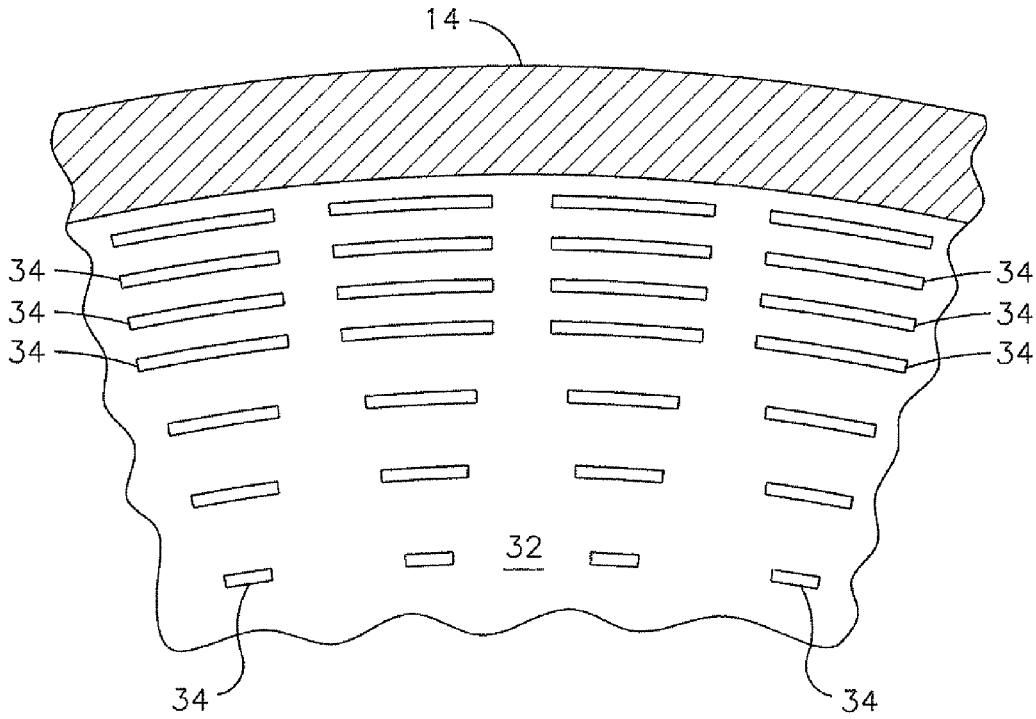
FIG. 3*a* is a planar view of a restraining member for use with the structure shown in FIG. 3 illustrating ventilation slots.

Referring now to FIG. 3, an alternate embodiment for retaining the members 27 within the cavity 20 is shown, where the grid 30 is replaced with a plate 32 having a multiplicity of openings such as slots 34 formed therein A non-symmetric distribution of the slots 34 may be formed in the plate 32. That is, more and/or larger slots 34 may be formed near the periphery of the plate 32; and smaller and/or fewer slots may be formed near the center of the plate 34. An example of such a distribution is illustrated in the plan view of FIG. 3*a*. The retaining structure at opposed ends 16*a*, 16*b* of the cavity 16 may be the same or they may have a different geometry, and as such, the retaining structures function as flow regulating/metering devices. The grid openings and/or other features formed in/on the retaining structures may be used to arrange the first layer of geometrically-shaped members 27 into a desired pattern, thereby facilitating the formation of a desired packing structure. The openings in the retaining structure plate 32 may be formed by any known means, such as sawing, drilling, milling, laser cutting, etc.

The embodiment illustrated in FIG. 1 includes a leading edge cooling passage 16 containing geometric shapes 27 and a trailing edge serpentine cooling passage 20 that is of a traditional design. One may appreciate that cooling passages containing geometric shapes may be used at any or all locations within the airfoil in other embodiments.

The present invention has numerous advantages over traditional airfoil cooling schemes. First, the preferential redirection of the coolant flow to the outer surfaces of the cavities increases the efficiency of the system. Moreover, the use of simple geometrically-shaped members 27 is a cost effective means for redirecting the coolant flow without the use of elaborate and expensive duct work.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A stationary vane for a gas turbine engine comprising:

an airfoil defined by a pressure side wall and a suction side wall joined at respective leading and trailing edges;

inner and outer platforms connected to the airfoil at respective opposed ends of the airfoil;

a cooling cavity defined between the pressure side wall and the suction side wall;

a plurality of geometrically-shaped members disposed in the cooling cavity for reducing an effective cross-sectional flow area of the cooling cavity by defining a plurality of cooling sub-passages around the geometric shapes; and inlet and outlet grates disposed at opposed ends of the cooling cavity for directing a cooling fluid into and out of the cooling cavity and for supporting the plurality of geometrically-shaped members within the cavity;

wherein the inlet and outlet grates comprise a distribution of openings preferentially allowing more coolant to flow there through proximate the wall than proximate a center of the cavity.

2. The vane of claim 1, wherein the geometrically-shaped members comprise spheres.

3. The vane of claim 1 wherein the geometrically-shaped members are uniformly sized spheres.

4. The vane of claim 1 wherein the geometrically-shaped members comprise spheres of a plurality of dimensions.

5. The vane of claim 1, wherein the geometrically-shaped members comprise more than one geometry.

6. The vane of claim 1, wherein the geometrically-shaped members comprise more than one size.

7. The vane of claim 1, wherein the geometrically-shaped members comprise a first size proximate the wall and a second size, smaller than the first size, remote from the wall.

8. The vane of claim 1, wherein the geometrically-shaped members comprise spheres comprising a first diameter proximate the wall and comprising a second diameter, smaller than the first diameter, remote from the wall.

9. A component comprising:

a wall which is heated by a hot combustion gas;

a cooling cavity at least partially defined by the wall;

a plurality of geometrically shaped members disposed within the cooling cavity and defining a plurality of cooling sub-passages there through; and a retaining structure disposed at an end of the cooling cavity for retaining the geometrically shaped members within the cavity while allowing the passage of a coolant there through;

wherein the geometrically shaped members stack against each other more closely than against the wall such that sub-passages proximate the wall are generally larger than sub-passages remote from the wall;

and wherein the retaining structure comprises a distribution of openings preferentially allowing more coolant to flow there through proximate the wall than proximate a center of the cavity.

10. The component of claim 9, wherein the geometrically-shaped members comprise spheres.

11. The component of claim 9 wherein the geometrically-shaped members are uniformly sized spheres.

12. The component of claim 9 wherein the geometrically-shaped members comprise spheres of a plurality of dimensions.

13. The component of claim 9, wherein the geometrically-shaped members comprise more than one geometry.

14. The component of claim 9, wherein the geometrically-shaped members comprise more than one size.

15. The component of claim 9, wherein the geometrically-shaped members comprise a first size proximate the wall and a second size, smaller than the first size, remote from the wall.

16. The component of claim 9, wherein the geometrically-shaped members comprise spheres comprising a first diameter proximate the wall and comprising a second diameter, smaller than the first diameter, remote from the wall.

* * * * *